US006113711A

United States Patent [19]

Armanie et al.

[11] Patent Number: 6,113,711

[45] Date of Patent: Sep. 5, 2000

[54] EXTRUSION OF ALUMINUM-LITHIUM ALLOYS

[75] Inventors: Kevin P. Armanie, Penn Hills; Roberto J. Rioja; Diana K. Denzer, both of Lower Burrell, all of Pa.; Charles E. Brooks, Lafayette, Ind.; Walter D. Coker, Birmingham, Ala.; Daniel K. Gadbery, Lafayette; Robert Newell, West Lafayette, both of Ind.

[73] Assignee: Aluminum Company of America, Pittsburgh, Pa.

[21] Appl. No.: 08/218,676

[22] Filed: Mar. 28, 1994

[51] Int. Cl.[7] ..... C22F 1/04

[52] U.S. Cl. ..... 148/689; 72/364; 72/372; 72/377; 148/688; 148/698; 148/415; 148/417; 148/439

[58] Field of Search ..... 148/689, 415, 148/417, 439, 688, 698; 72/364, 372, 377

[56] References Cited

U.S. PATENT DOCUMENTS

| | | | |
|---|---|---|---|
| 4,961,792 | 10/1990 | Rioja et al. | 148/437 |
| 5,151,136 | 9/1992 | Witters et al. | 148/689 |

OTHER PUBLICATIONS

Denzer, D. K. et al, Texture and Properties of 2090,8090 and 7050 Extruded Products, presented at the Sixth Annual International Aluminum–Lithium Conference, Garmisch–Partenkirchen, Germany, Oct. 7–11, 1991.

Tempus, G. et al, Influence of Extrusion Process Parameters on the Mechanical Properties of Al–Li–Extrusions, Published in A1–Li IV, Paris, 1987.

Calles, W. et al, Influence of Alloying Elements and Temper on the Mechanical Properties of A1–Mg–Li–Alloys of the 01420–Type, 6th Int. A1–Li–Conference, Garmisch, Oct. 1991.

*Primary Examiner*—Deborah Jones
*Assistant Examiner*—Robert R. Koehler
*Attorney, Agent, or Firm*—David W. Brownlee; Edward L. Levine; David W. Pearce-Smith

[57] ABSTRACT

Disclosed is a method of making lithium-containing aluminum base alloy extrusion having at least a section thereof having a low aspect ratio or which is generally axisymmetrical, the extrusions having improved properties in sections thereof having the low aspect ratio or which are axisymmetrical. The method comprises providing a body of a lithium-containing aluminum alloy, pressing a portion of the body which is to form the axisymmetrical or low aspect ratio section through a tortuous path and extruding an axisymmetrical or a low aspect ratio extrusion section. The axisymmetrical or low aspect ratio section of the extrusion has a tensile strength of at least 60 ksi and an ultimate yield strength at least 4.5 ksi greater than the tensile yield strength.

15 Claims, 2 Drawing Sheets

EXTRUSION OF ALUMINUM-LITHIUM ALLOYS

This invention relates to a process for extruding aluminum alloys and in particular to a process for extruding aluminum alloys containing lithium to improve the properties of the extrusions so produced.

BACKGROUND OF THE INVENTION

It has been generally recognized that one of the most effective ways to reduce the weight of an aircraft is to reduce the density of aluminum alloys used in the aircraft construction. For purposes of reducing the alloy density, lithium additions have been made. However, the addition of lithium to aluminum alloys is not without problems. For example, extrusion of aluminum—lithium alloys using conventional flat faced extrusion dies to produce thick and/or low aspect ratio aluminum—lithium extrusions results in materials which sometimes display low elongations, poor fracture toughness and high anisotropy of mechanical properties. These characteristics have been associated with cracking problems in the extruded product during certain fabrication procedures, especially during machining operations which are performed on some extrusions. There is also concern regarding the load transfer capability of thick and/or low aspect ratio aluminum—lithium extrusions. This is because such extrusions have a small spread between ultimate tensile strength (UTS) and tensile yield strength (TYS). This problem is also sometimes present in portions of the extruded shape which are formed by generally axisymmetrical metal flow, even if the portion has a high aspect ratio.

As used in the art, the term aspect ratio means the ratio of the width to thickness in cross section of an extrusion or a portion of an extrusion. A low aspect ratio is in the range of approximately 1–4:1. A 1:1 ratio means that the extrusion or the portion of the extrusion has approximately a round or square cross section. A ratio of 4:1 means that the width of the extrusion would be approximately 4 times the thickness of the extrusion in cross section.

The influence of the extrusion process parameters on mechanical properties of different aluminum—lithium extrusions was investigated by Tempus et al as published in *Aluminum Lithium*, Vol. 4, (1987). The strength of the extrusion was shown to be influenced more by the extrusion aspect ratio, (width/thickness) which determines texture, than by extrusion temperature and extrusion ratio. With increasing extrusion aspect ratio, the strength declines considerably. Tempus et al revealed that a small difference between UTS and TYS in aluminum—lithium extrusions is associated with a fiber texture. If an extrusion does not undergo recrystallization during solution heat treatment, the region of the extrusion where the flow resembles axisymmetric deformation exhibits a fiber texture. In contrast, when deformation conditions are more like plane strain, the resulting extrusion or section of an extrusion contains a more equiaxed type texture. The later is typical of extrusions with a high aspect ratio which have an acceptable difference between UTS and TYS and which will machine well with little or no cracking.

A paper entitled *Texture and Properties of* 2090, 8090 *and* 7050 *Extruded Products*, by D. K. Denzer, P. A. Hollingshead, J. Liu, K. P. Armanie and R. J. Rioja, which was presented at the Sixth Annual International Aluminum—Lithium Conference, Garmisch-Partenkirchen, Germany, Oct. 7–11, 1991, contains a further discussion of the correlation between extrusion aspect ratio and tensile strength in aluminum—lithium extrusions.

U.S. Pat. No. 5,151,136 discloses a method for producing low aspect ratio aluminum—lithium extrusions with improved properties in which the low aspect ratio section of the extrusion is reduced by at least 4:1 (extrusion ratio) during the extrusion reduction.

A method is desired for producing aluminum—lithium alloy extrusions having portions thereof with a low aspect ratio with improved elongation, improved fracture toughness and other mechanical properties.

SUMMARY OF THE INVENTION

This invention provides a method of extruding a lithium-containing aluminum alloy to form an extrusion having at least a portion thereof with a low aspect ratio and/or which is formed by axisymmetric deformation. In this method, the ingot is forced to flow through a tortuous path to work the alloy prior to extruding the alloy through a die aperture. One embodiment of this invention utilizes a spreader plate in front of the extrusion die to improve ductility and increase the spread between UTS and TYS in the extrusion that is produced. Improvements in ductility and spread between UTS and TYS in accordance with this invention facilitates the use of aluminum—lithium extrusions in many otherwise unacceptable applications. This invention results in overall improvement in mechanical behavior of aluminum—lithium alloys which are produced in accordance with the invention.

An object of this invention is to provide a method for producing an improved lithium-containing aluminum base alloy extrusion.

Another object of this invention is to provide lithium-containing aluminum base alloy extrusion having low aspect ratio sections thereof having improved properties.

A further object of this invention is to provide a lithium-containing aluminum base alloy extrusion having low aspect ratio sections (4:1 or less) having TYS greater than 70 ksi and having a UTS of at least 4.0 ksi greater than the TYS.

Another object of this invention is to provide a method for producing aluminum lithium extrusions having portions thereof which are generally axisymmetric and which have improved properties.

These and other objects will become apparent from the specification, drawings and claims appended hereto.

DETAILED DESCRIPTION OF THE PREFERRED EMBODIMENTS

Figure 1:
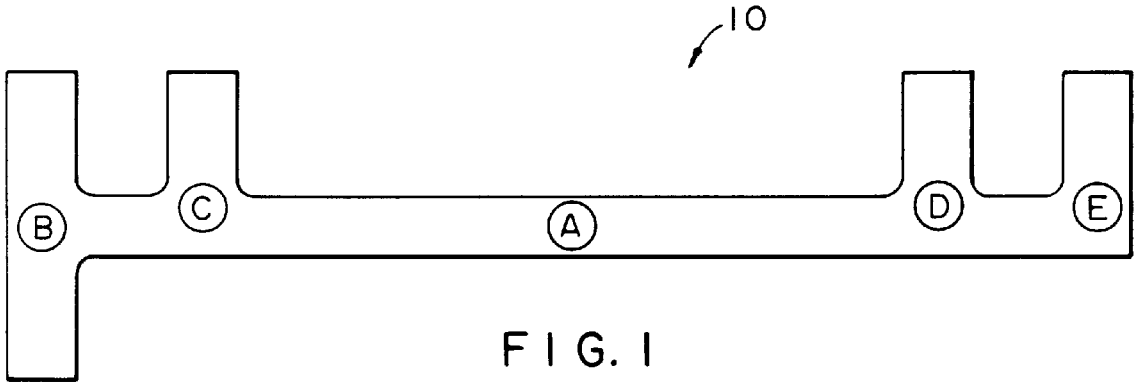
FIG. 1 is a cross section of an extrusion having sections thereof with low and high aspect ratios.

By low aspect ratio is meant a ratio in the range of 1–4 to 1. By high aspect ratio is meant a ratio greater than 4 (4 to 1). By aspect ratio is meant the ratio of width to thickness, as shown in FIG. 1, for example. In a simple extrusion, e.g., an extrusion having a rectangular, square or circular cross section, the aspect ratio is the ratio of the width to the thickness of the extrusion. For extrusions having square or circular cross sections, the aspect ratio is 1 (1 to 1).

FIG. 1 shows an aircraft floor beam 10 extrusion having both a high aspect ratio section A and low aspect ratio sections B, C, D and E. Section A has a high aspect ratio and generally has satisfactory properties when formed by using conventional flat faced dies. Sections B, C, D and E have low aspect ratios and have typically exhibited "chunkiness" which means they have a low UTS to TYS spread, low ductility, poor fracture toughness, high anisotropy of mechanical properties, and a fibrous texture. The sections of the extrusions having low aspect ratios have inferior properties compared to the section having high aspect ratios. The low aspect ratio section may have: (1) very high longitudinal TYS, e.g., 90 ksi; (2) small difference between longitudinal UTS and TYS, e.g., 1.6 ksi or less; and (3) poor fracture toughness, e.g., less than 15 ksi √in. Such properties can exist even when the low aspect ratio section has undergone considerable work, e.g., even after an extrusion ratio of 7:1.

Figure 2:
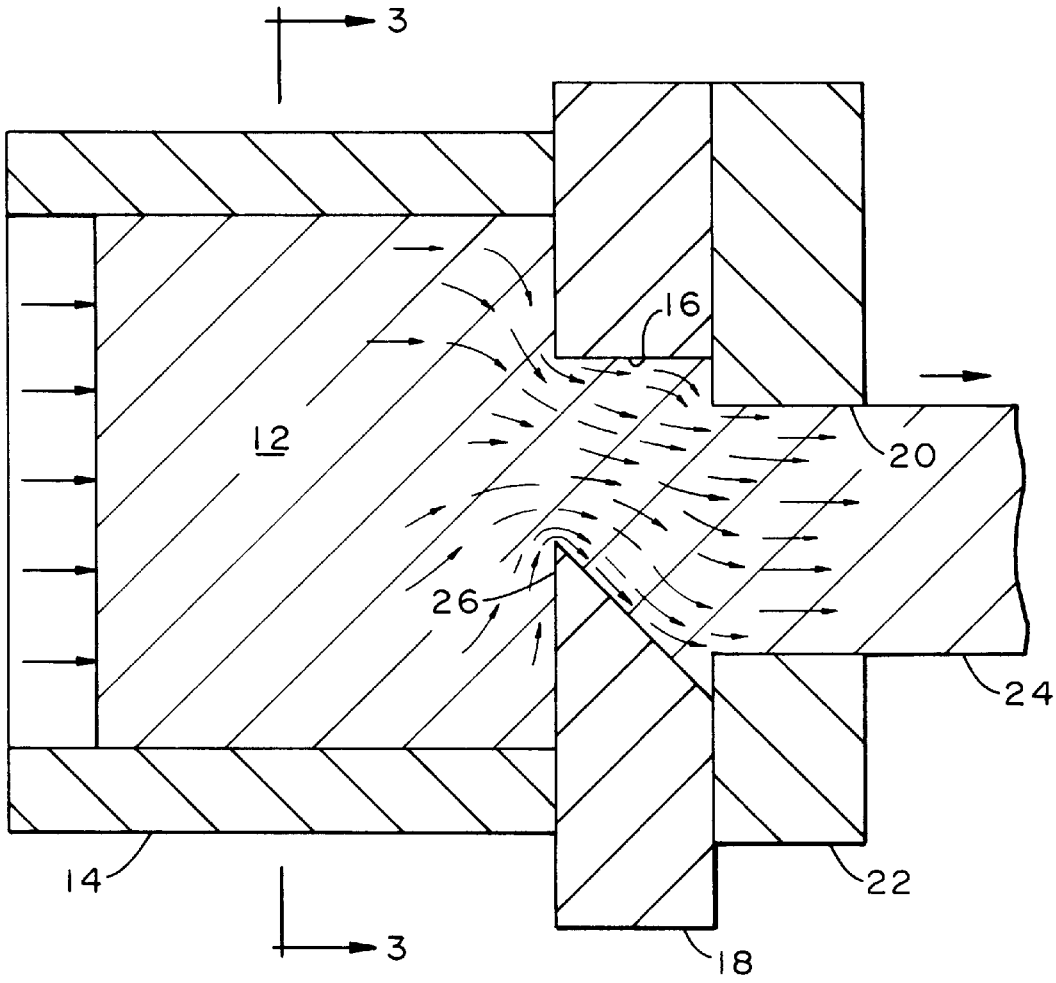
FIG. 2 is a schematic drawing of apparatus for forming an aluminum—lithium extrusion in accordance with this invention to produce improved properties in the low aspect ratio sections of the extrusion and showing the metal flow of the aluminum alloy during the extrusion process.
Figure 3:
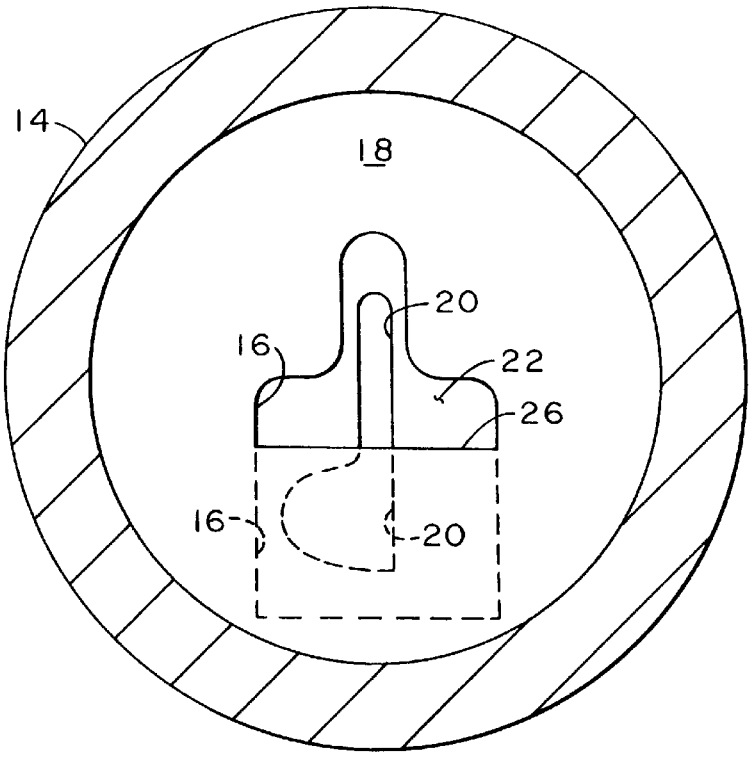
FIG. 3 is transverse cross-sectional view taken along line 3—3 through the apparatus of FIG. 2 with the ingot removed.

In accordance with this invention, the properties in the sections having low aspect ratios or which are formed by axisymmetric metal flow are improved by pressing the portion of the ingot to be formed into such section through a tortuous path before it is extruded through the die aperture. As used herein, a tortuous path that includes at least one bend or turn in the metal flow in addition to that required for the metal to flow through the extrusion die. In a preferred method of this invention, the tortuous path results from the use of a spreader die as shown in FIG. 2. The ingot or billet 12 in container 14 is pressed or pushed by an extrusion stem (not shown) through an aperture 16 in a spreader die 18, and then through an aperture 20 in a flat faced die 22 to form extrusion 24 having a cross-sectional profile as shown in FIG. 3. The extrusion 24 has a section A having a low aspect ratio and a sections B, C, D and E having high aspect ratios (less than 4). The spreader die 18 has a lip portion 26 across the bottom of the aperture 16 in the die, as best been in FIG. 3. The lip 26 interferes with the flow of metal and forces the aluminum alloy in ingot 12 to change directions and flow in a tortuous path over the lip before the alloy is expressed through the die aperture 20. Surprisingly, the use of the spreader plate permits the extrusion of aluminum lithium alloys that do not exhibit chunkiness in the low aspect ratio areas of the extruded product. It is believed that this movement of the alloy in a tortuous path results in working of the alloy to a greater extent than would normally be the case in forming low aspect ratio portions of an extrusion and that this increased working improves the properties of such low aspect portions of the extrusion. The tortuous path also results in increased localized strain rates of the metal.

It is important to note that the lip 26 in the spreader die 18 extends only across the bottom of the die 18 that the spreader die results in tortuous flow path only for the metal that is extruded into the low aspect ratio portion of the extruded product. The flow path for the portion of the billet that becomes the high aspect ratio portion of the extruded product is not tortuous. Instead, the flow path for the high ratio portion of the billet is a more typical laminar flow path. If all portions of an extruded product have a low aspect ratio(s), as with a square or round extrusion, then in accordance with this invention substantially all of the metal in the billet should flow along a tortuous path.

The lip 26 is not disposed across portions of the spreader die which forms the high aspect ratio portions of the extruded product so the metal that forms such high aspect ratio portions of the product do not flow along a tortuous path. This is because pressing the alloy that forms the high aspect ratio portions of the product along a tortuous path would require an unnecessary increase in the working and little or no improvement in properties for that portion of the product. In fact, some test data suggests that the properties may even be reduced if the metal that forms the high aspect ratio sections also flows along a tortuous path. Thus it is important to this invention that the tortuous flow path be applied only for that portion of the billet that forms the low aspect ratio portion of the extruded product.

Figure 4:
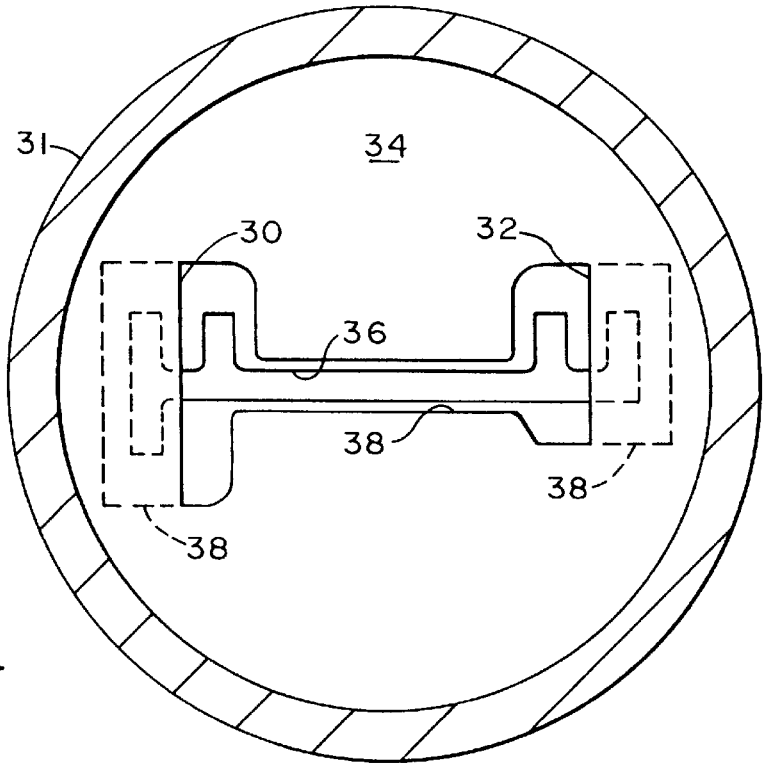
FIG. 4 is a transverse cross-sectional view similar to FIG. 3 except showing the profile of the aperture in the spreader plate for forming the extrusion of FIG. 1.

FIG. 4 shows the profiles of lips 30 and 32 on a spreader plate 34 for forming the floor beam 10 extrusion of FIG. 1 in apparatus similar to that shown in FIG. 2. The lips 30 and 32 on the spreader plate 34 force the aluminum lithium alloy that will form the low aspect portions of the extrude body to flow along a tortuous path before it is extruded through the die aperture 36. The profile of the exit aperture 38 in the spreader plate 34 is shaped like a dog bone with the lips 30 and 32 partially obstructing the flow of metal through the ends of the aperture.

Aluminum—lithium alloys which may be formed into extrusions with this invention can contain 0.2 to 5.0 wt. % Li, 0 to 5.0 wt. % Mg, up to 6.5 wt. % Cu, 0 to 1.0 wt. % Zr, 0 to 2.0 wt. % Mn, 0.05 to 12.0 wt. % Zn, up to 2 wt. % Ag, 0.5 wt. % max. Fe, 0.5 wt. % max. Si, the balance aluminum and incidental elements and impurities. The impurities are preferably limited to about 0.05 wt. % each, and the combination of impurities preferably should not exceed 0.35 wt. %.

A preferred alloy in accordance with the present invention can contain 0.2 to 5.0 wt. % Li, at least 0.5 wt. % Cu, 0 to 1.0 wt. % Ag, 0.05 to 5.0 wt. % Mg, 0 to 1.0 wt. % Mn, 0.05 to 0.16 wt. % Zr, 0.05 to 12.0 wt. % Zn, the balance aluminum and incidental elements and impurities as specified above. A typical alloy composition would contain 1.0 to 3.0 wt. % Li, 2.0 to 2.9 wt. % Cu, 0.05 to 2.5 wt. % Mg, 0.05 to 11.0 wt. % Zn, 0 to 0.09 wt. % Zr, 0 to 1.0 wt. % Mn and max. 0.1 wt. % of each of Fe and Si. In a preferred typical alloy, Zn may be in the range of 0.05 to 2.0 and Mg 0.05 to 2.0 wt. %.

In the present invention, lithium is important not only because it permits a significant decrease in density but also because it improves tensile and yield strengths markedly as well as improving elastic modulus. Additionally, the presence of lithium improves fatigue resistance. Most significantly though, the presence of lithium in combination with other controlled amounts of alloying elements permits aluminum alloy products which can be worked to provide unique combinations of strength and fracture toughness while maintaining meaningful reductions in density. Toughness or fracture toughness as used herein refers to the resistance of a body, e.g., extrusion, sheet or plate, to the unstable growth of cracks or other flaws.

Other lithium-containing aluminum alloys which may be extruded to provide a product in accordance with the invention include Aluminum Association Alloy (AA) 2090, 2091, 2094, 2095, 2096, 2097, 8090, 8091, 8190, 2020, 2195 and Russian alloys, 1420, 1421, 1430, 1440, 1441, 1450 and 1460.

The aluminum—lithium alloy for use with this invention is prepared according to specific method steps in order to provide the most desirable characteristics of the extrusion. Thus, the alloy as described herein can be provided as an ingot or billet for fabrication into a suitable extruded product by casting techniques currently employed in the art for cast products. The ingot or billet may be preliminarily worked or shaped to provide suitable stock for subsequent working operations. Prior to the principal working operation, the alloy stock is preferably subjected to homogenization, and preferably at metal temperatures in the range of 800 to 1050° F. for a period of time of at least one hour to dissolve soluble elements such as Li and Cu, and to homogenize the internal structure of the metal. A preferred time period is about 20 hours or more in the homogenization temperature range. Normally, the heat-up and homogenizing treatment does not have to extend for more than 40 hours; however, longer times are not normally detrimental. A time of 20 to 40 hours at the homogenization temperature has been found quite suitable. In addition to dissolving constituent phases to promote workability, this homogenization treatment is important in that it aids precipitation of Mn and/or Zr-bearing dispersoids which help to control final grain structure.

After the homogenizing treatment, the ingot is usually scalped and then extruded to produce extrusions.

When the ingot is comprised of the preferred alloy noted above, and Zn is maintained at less than 1 wt. %, typically 0–1 wt. % and Zr in the range of 0 to 0.12 wt. %, then preferably the ingot is heated in the temperature range of 500 to 1050° F., typically 500 to 950° F., and maintained in this range during the extruding process.

After extruding the ingot to the desired shape, the extrusion is preferably subjected to a solution heat treatment to dissolve soluble elements. The solution heat treatment is preferably accomplished at a temperature in the range of 900 to 1050° F. and preferably produces a recovered or recrystallized grain structure.

Solution heat treatment can be performed in batches. Solution effects can occur fairly rapidly, for instance in as little as 30 to 60 seconds, once the metal has reached a solution temperature of about 900 to 1050° F. However, heating the metal to that temperature can involve substantial amounts of time depending on the type of operation involved. In batch treating in a production plant, the extrusions are treated in a furnace load and an amount of time is required to bring the entire load to solution temperature, and accordingly, batch solution heat treating can consume one or more hours.

To further provide the desired strengths necessary in the final product, the extrusions should be rapidly quenched to prevent or minimize uncontrolled precipitation.

An extrusion produced by the present invention may be artificially aged to provide the combination of fracture toughness and strength which is so highly desired in extrusion members of this type. This can be accomplished by subjecting the extrusion product to a temperature in the range of 150 to 400° F. for a sufficient period of time to further increase the yield strength. Preferably, artificial aging is accomplished by subjecting the alloy product to a temperature in the range of 275 to 375° F. for a period of at least 30 minutes. A suitable aging practice contemplates a treatment of about 8 to 24 hours at a temperature of about 325° F. Further, it will be noted that the alloy product in accordance with the present invention may be subjected to any of the typical underaging treatments, including natural aging. Also, while reference has been made herein to single aging steps, multiple aging steps, such as two or three aging steps, are contemplated and may be used.

While the ingot may be extruded in a one-step extrusion, two or even multiple steps may be employed. Thus, in the first step, the ingot may be extruded to preliminarily work the ingot without extruding to shape. That is, a 16" diameter ingot may be first extruded to 9" diameter rod before extruding to a final shape. Or, the ingot may be preliminarily shaped by a shaping step such as forging or rolling and thereafter extruded to a final shape. Between the extruding steps, the preliminarily worked or shaped ingot may be subjected to a thermal treatment, prior to extruding to the final shape. The thermal treatment is designed to minimize undesirable crystallographic texture. The thermal treatment can be in the temperature range of 400 to 1020° F., preferably 500 to 900° F., for a time period in the range of 8 to 24 hours. Usually, time in the temperature range is not needed to exceed 20 hours. In the first or preliminary working or extruding step, the amount of work should be at least 30% and preferably at least 40%.

Following these steps can result in an extrusion with section thereof having low aspect ratios, yet exhibiting improved properties. That is, differences of at least 4.5 ksi can be achieved between TYS and UTS in both the low aspect ratio portions of the extrusion as well as the high aspect ratio portions of the extrusion.

The following example is further illustrative of the invention:

EXAMPLE

Ingots 15"×60"×100" long were cast having the composition, in wt. %, 2.07 Li, 2.79 Cu, 0.10 Zr, and remainder Al (known as Alloy 2090). The ingots were homogenized for 8 hours at 950° F. and 24 hours at 1000° F. and then machined to an extrusion billet 9" in diameter. For extruding, the billets were heated to about 850° F., and the extrusion cylinder was maintained at about the same temperature during extrusion. The billets were extruded to the shape shown in FIG. 1 at 2 inches per minute ram speed or product speed with an extrusion ratio of approximately 7 to 1. The billets were extruded using three different die arrangements. The first arrangement was a conventional flat die with no feeder or spreader die. The second was a conventional feeder die which provided a restriction for the billet to flow through before extrusion through the die aperture. The third included a spreader plate for extrusion in accordance with this invention. The extrusions were solution heat treated for about 0.5 to 1 hours at about 1000° F., then cold water quenched and stretched about 6% of their original length. Thereafter, the extrusions were aged at 300° F. for 30 hours. Table I below gives the results for floor beam extrusions (FIGS. 1 and 4), and Table II gives the results for hinge extrusions (FIGS. 2 and 3). The letters R and F in table stand for "rear" and "front", meaning that the test results are for two sections of each extrusion with one (R) being approximately 2½ ft. from the "rear" end of the extrusion and the other (F) being approximately 2½ ft. from the "front" end of the extrusion. From the Tables, it is seen that extrusions produced in accordance with this invention have improved properties, as shown by the difference between UTS minus TYS and the elongation percents compared against an extrusion made by prior art practices (flat and feeder dies).

TABLE I

| | | LOW ASPECT RATIO REGION B (FIG. 1) | | | | HIGH ASPECT RATIO REGIONS A (FIG. 1) | | | |
|---|---|---|---|---|---|---|---|---|---|
| DIE | | UTS (ksi) | TYS (ksi) | UTS – TYS (ksi) | % el | UTS (ksi) | TYS (ksi) | UTS – TYS (ksi) | % el |
| FLAT | R | 90.5 | 88.3 | 2.2 | 8.0 | 82.1 | 78.3 | 3.8 | 7.0 |
| | F | 89.8 | 88.4 | 1.4 | 10.0 | 82.9 | 78.0 | 4.9 | 9.0 |
| FEEDER | R | 92.8 | 90.0 | 2.8 | 8.0 | 86.0 | 81.7 | 4.3 | 8.0 |
| | F | 92.7 | 91.2 | 1.5 | 9.0 | 84.0 | 80.9 | 3.1 | 7.0 |
| SPREADER | R | 77.9 | 71.3 | 6.6 | 16.0 | 80.0 | 74.8 | 5.2 | 9.0 |
| | F | 78.0 | 72.5 | 5.5 | 8.0 | 83.6 | 79.0 | 4.6 | 9.0 |

TABLE II

| | Test Location in Center of Section A (FIG. 2) | | | |
|---|---|---|---|---|
| | TYS (ksi) | UTS (ksi) | % elongation | UTS-TYS |
| Flat - F | 97.6 | 97.9 | 2.0 | 0.3 |
| - R | 98.8 | 99.2 | 2.0 | .04 |
| Spreader - F | 77.6 | 87.4 | 10.0 | 9.8 |
| - R | 82.7 | 87.3 | 10.0 | 4.6 |

While the invention has been described in terms of direct extrusion in which the metal is forced by a ram through a stationary die, it is not so limited. Those skilled in the art will recognize that the invention can also be practiced in an indirect extrusion process.

It is also contemplated the required tortuous flow path for the metal extruded in accordance with this invention can be provided by means other than a spreader die. Such means might be in the form of bridges or other obstruction positioned in the extrusion chamber which force the billet to follow a tortuous path or change of direction before being extruded through the die aperture.

What is claimed is:

1. A method of extruding a lithium-containing aluminum alloy to form an extruded product having at least one section thereof with a low aspect ratio not greater than approximately 4 and at least one section having a high aspect ratio greater than approximately 4, said method comprising providing a billet of an aluminum—lithium alloy, pressing at least a portion of said billet which forms said low aspect ratio section along a tortuous path which includes deforming said aluminum—lithium alloy sequentially away from and toward the longitudinal mass center of the portion of said section having a low aspect ratio and thereafter extruding said portion through an extrusion die aperture to form an extrusion having an ultimate yield strength at least 4.0 ksi greater than tensile yield strength in the low aspect ratio section of the extrusion.

2. A method as set forth in claim 1 in which the microstructure and crystallographic texture of said aluminum—lithium alloy is altered by said method.

3. A method as set forth in claim 1 in which said deforming of said aluminum lithium alloy away from the longitudinal mass center precedes deforming said alloy toward such mass center.

4. A method as set forth in claim 1 in which said pressing of a section of the ingot through a tortuous path includes moving said low aspect ratio section through a spreader die.

5. A method as set forth in claim 1 in which the ingot is extruded through the die aperture immediately after it flows through said tortuous path.

6. A method as set forth in claim 1 in which the portion of said billet that is pressed along a tortuous path is extruded through an extrusion die aperture to form a low aspect ratio portion of an extrusion.

7. A method as set forth in claim 1 in which the portion of said billet that is pressed along a tortuous path is extruded thus an extrusion die aperture into a portion of an extrusion produced by generally axisymmetrical metal flow.

8. In a method of extruding a lithium-containing aluminum alloy billet to form an extrusion having at least a portion of the cross-section thereof with a high aspect ratio greater than about 4 and at least a portion having a low aspect ratio not greater than 4, the improvement comprising moving a portion of the billet which forms said low aspect ratio portion along a tortuous path immediately prior to extruding said billet through an extrusion die aperture, wherein said tortuous path includes flow directions sequentially away from and toward the longitudinal mass center of the portion of said portion having a low aspect ratio to form an extrusion having an ultimate yield strength at least 4.0 ksi greater than tensile yield strength in the low aspect ratio portion of the extrusion.

9. A method in accordance with claim 8 in which said billet is subjected to a thermal treatment in a temperature range of 800 to 1050° F. prior to being extruded.

10. A method in accordance with claim 9 wherein the thermal treatment is carried out in a time of 1 to 50 hours.

11. A method in accordance with claim 8 wherein said extrusion is subjected to a thermal treatment in the range of 900 to 1050° F.

12. A method in accordance with claim 8 wherein said billet is reduced in cross section by at least 30% by said method.

13. A method of forming an aluminum—lithium aircraft floor beam having at least one portion of the cross-section having a high aspect ratio greater than about 4 and at least a portion having a low aspect ratio not greater than 4 or which is generally axisymmetrical, said method comprising heating an aluminum—lithium body to about 850° F., pressing said body through a spreader plate which obstructs the flow of the alloy into said at least one portion and thereafter extruding said body through a die aperture to form said floor beam whereby the alloy that forms said at least one portion flows in a tortuous path sequentially away from and toward the longitudinal mass center of said portion with localized high strain rates to form an extrusion having a TYS of at least 70 ksi and a UTS of at least 74 ksi in the low aspect ratio portion of the extrusion after solution heat treating and aging.

14. A method as set forth in claim 13 in which said extrusion is heat treated for about 0.5 to 1.0 hours at about 1000° F. after it has been extruded.

15. A method as set forth in claim 13 in which said aluminum—lithium body is Aluminum Association 2090 alloy.

* * * * *